US006742191B2

(12) United States Patent
Yang

(10) Patent No.: US 6,742,191 B2
(45) Date of Patent: Jun. 1, 2004

(54) HEAD MOUNTED UMBRELLA AND METHOD OF MANUFACTURING THE SAME

(75) Inventor: Jae Bong Yang, Seoul (KR)

(73) Assignee: Man Ho Yang (KR)

( * ) Notice: Subject to any disclaimer, the term of this patent is extended or adjusted under 35 U.S.C. 154(b) by 8 days.

(21) Appl. No.: 10/184,256

(22) Filed: Jun. 27, 2002

(65) Prior Publication Data

US 2004/0000332 A1 Jan. 1, 2004

(51) Int. Cl.[7] ..... A42B 1/00; A41D 3/04

(52) U.S. Cl. ..... 2/417; 2/410; 2/84; 2/202; 135/16; 135/96

(58) Field of Search ..... 135/16, 15.1, 96; 2/410, 417, 171.03, 202, 84

(56) References Cited

U.S. PATENT DOCUMENTS 219,243 A * 9/1879 Frankl
2,131,248 A * 9/1938 Astrove
2,241,694 A * 5/1941 Astrove
2,376,284 A * 5/1945 Sidelmann
2,839,757 A * 6/1958 Gianola
4,980,928 A * 1/1991 Ellis
5,101,513 A * 4/1992 Bowers ..... 2/84
6,532,596 B1 * 3/2003 Fosmo

FOREIGN PATENT DOCUMENTS

WO WO 02/094052 A1 * 11/2002

OTHER PUBLICATIONS

Derwent–Acc–No: 2003–227306.*
Derwent–Acc–No: 2003–019988.*

* cited by examiner

*Primary Examiner*—Robert Canfield
(74) *Attorney, Agent, or Firm*—Robert W. Becker & Associates; Robert W. Becker

(57) ABSTRACT

A head mounted umbrella and a method thereof, which reduces its manufacturing cost and time and is stably held on a user's body without shaking, and which prevents a user's face from getting wet with rain water, and is hung on a hanger, is disclosed. The head mounted umbrella includes a hood part having a front opening, a body covering part manufactured in such a way that a circular basic cloth having a central opening and at least one cut radial portion is prepared, and adjacent radial edges of the basic cloth are coupled to each other to form a skirt shape, and the skirt-shaped cloth is coupled to a lower edge of the hood part, and an annular elastic ring is coupled to an outer peripheral edge of the body covering part by an attaching cloth strip.

6 Claims, 6 Drawing Sheets

HEAD MOUNTED UMBRELLA AND METHOD OF MANUFACTURING THE SAME

FIELD OF THE INVENTION

The present invention relates to an umbrella that is adapted to be mounted on a user's head and shoulders, and to a method of manufacturing the same, which is intended to shelter the user from the rain, and more particularly to a head mounted umbrella and a method of manufacturing the same which is intended to reduce its manufacturing cost and time and to be stably held on a user's body without shaking, and which is intended to prevent a user's face from getting wet with rain water by the transparent hood shade, and to be conveniently hung on a hanger by its hook member.

BACKGROUND ART

In past times, a head mounted umbrella, which is used for sheltering a user from the rain as shown in FIG. 1, has been produced and put on the market by the inventor.

The head mounted umbrella proposed by the inventor comprises a hood part 10 made of a waterproof material and having a front opening, a body covering part 11 made of a waterproof material, which is coupled to a lower circumferential edge of the hood part 10 and formed into a skirt shape or a conical shape, and an annular elastic ring 12 coupled to an outer peripheral edge of the body covering part 11 by an attaching cloth strip 12*a*.

The prior art head mounted umbrella is generally manufactured in such a way that the hood part 10 and the body covering part 11 having the annular elastic ring 12 attached thereto are separately prepared, and the body covering part 11 is attached to the lower edge of the hood part 10 by a sewing operation.

More specifically, a waterproof cloth is first cut to obtain a basic cloth 11' having a central opening 11*a* and a circular peripheral edge 11*b*, as shown in FIG. 2*a*. Thereafter, the annular elastic ring 12 is attached to the peripheral edge 11*b* of the basic cloth 11' by the attaching cloth strip 12*a*, as shown in FIG. 2*b*. In this procedure, the annular elastic ring 12 is brought into contact with an inner surface of the loop-shaped attaching cloth strip 12*a*, and the attaching cloth strip 12*a* is inwardly folded at upper and lower edges of the elastic ring 12 to form a "U" shape in section. Subsequently, the peripheral edge 11*b* of the basic cloth 11' is disposed between the upper and lower folded edges of the attaching cloth strip 12*a*, and the upper and lower folded edges of the attaching cloth strip 12*a* are sewn together with the basic cloth 11', so that the elastic ring 12 is securely attached to the peripheral edge of the basic cloth 11'.

Thereafter, the basic cloth 11' and the elastic ring 12 attached to each other are interposed between an upper mold 1 and a lower mold 2, and then heated to be shaped into a desired skirt form, as shown in FIG. 2*c*.

As a result, a skirt-shaped body covering part 11 is produced, as shown in FIG. 2*d*.

Since the above prior art head mounted umbrella is adapted to be worn on a user's head to shelter the user from the rain without using both of his hands, the umbrella can afford convenient use to a user. Furthermore, since the annular elastic ring 12 can be folded several times to be compact, the umbrella is easy to store and carry.

However, since the above head mounted umbrella requires expensive molds and a molding process in a manufacturing process of the body covering part 11, considerable manufacturing costs and time are consumed. In addition, since this kind of head mounted umbrella must be produced in various sizes, i.e., umbrellas for children, umbrellas for young people and umbrellas for adults, and thus various molds suited for the several sized umbrella must be used, manufacturing cost for the umbrellas is further increased.

In addition to the above problems, the prior art umbrella has another problem in that the head mounted umbrella cannot thoroughly shield a user from the rain because the body covering part 11 of the umbrella is shaken by wind or collision with an adjacent umbrella. Furthermore, a user cannot prevent his face from getting wet with rain water through a face opening of the hood part of the umbrella, and also the umbrella cannot be hung on a hanger in a storage closet.

DISCLOSURE OF THE INVENTION

Accordingly, the present invention has been made keeping in mind the above problems occurring in the prior art, and an object of the present invention is to provide a head mounted umbrella which is intended to remarkably reduce its manufacturing cost and time period by eliminating a shaping process by molds.

Another object of the present invention is to provide a head mounted umbrella, which is adapted to be stably worn on a user without shaking when the umbrella is exposed to wind or collides with an adjacent umbrella.

Still another object of the present invention is to provide a head mounted umbrella which is intended to prevent a user's face from getting wet with rain water through a front face opening of its hood part.

A further object of the present invention is to provide a head mounted umbrella, which is adapted to be easily hung on a hanger.

A further object of the present invention is to provide a head mounted umbrella and a method thereof which is adapted to be stably worn on a user without its shaking when the umbrella is exposed to wind or collides with an adjacent umbrella.

In order to accomplish the above objects, the present invention provides a head mounted umbrella comprising: a hood partially made of a waterproof material and having a front opening; a body covering part made of a waterproof material, which is manufactured in such a way that a circular basic cloth having a central opening and at least one cut portion, the cut portion being extended between an edge of the central opening and an outer edge of the basic cloth and widened toward the outer edge of the basic cloth, is prepared, and adjacent radial edges of the basic cloth are coupled to each other to form a skirt shape, and which is coupled to a lower edge of the hood part; and an annular elastic ring coupled to an outer peripheral edge of the body covering part by an attaching cloth strip.

The body covering part may be provided with a pair of auxiliary straps at both sides of its lower surface corresponding to a user's two shoulders.

The hood part may be provided with a hood shade at an upper edge of the front opening, which is forwardly extended by a certain length, and may be provided with a chin strap which is attached at its one end to a side of the hood part below the front opening to encircle a user's chin portion, the other end of the chin strap being provided with a fastening member, the hood part being provided at the other side below the front opening with a fastening member to mate with the fastening member of the chin strap.

The body covering part may be provided at its outer peripheral edge with a hook member attached thereto.

In order to accomplish the above objects, the present invention provides a method of manufacturing a head mounted umbrella, comprising the steps of: preparing a hood part made of a waterproof cloth and having a front opening; preparing a body covering part made of a waterproof cloth, which is manufactured in such a way that a circular basic cloth having a circular edge is cut away to have a central opening and at least one cut portion such that the cut portion is extended between an edge of the central opening and the outer edge of the basic cloth and widened toward the outer edge of the basic cloth; connecting adjacent radial edges of the basic cloth to each other to form a skirt shape; and attaching an annular elastic ring to the outer edge of the skirt-shaped basic cloth by an attaching strip.

BRIEF DESCRIPTION OF THE DRAWINGS

The above and other objects, features and advantages of the present invention will be more clearly understood from the following detailed description taken in conjunction with the accompanying schematic drawings, in which.

DESCRIPTION OF PREFERRED EMBODIMENTS

Figure 1:
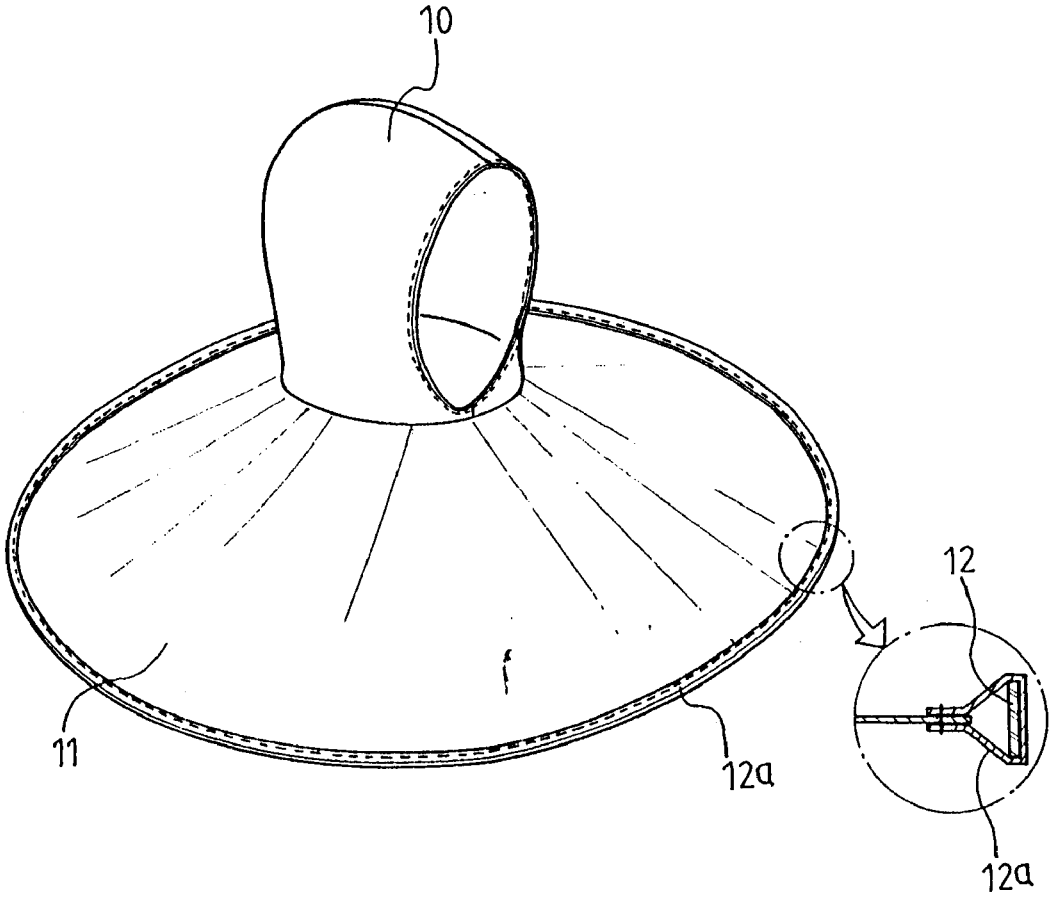
FIG. 1 PRIOR ART
FIG. 1 is a perspective view of a prior art head mounted umbrella.
Figure 2A:
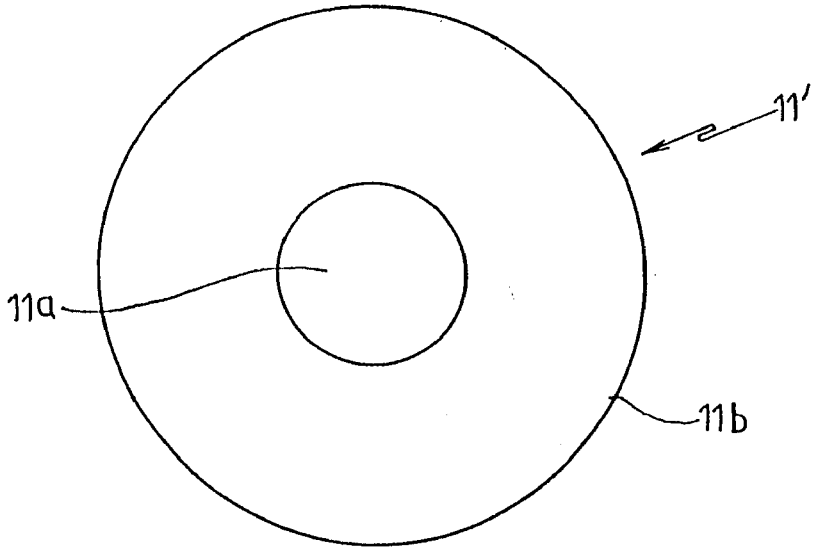
FIG. 2a PRIOR ART
FIGS. 2*a* to 2*d* show a process of manufacturing a body covering part of the prior art umbrella.
Figure 2B:
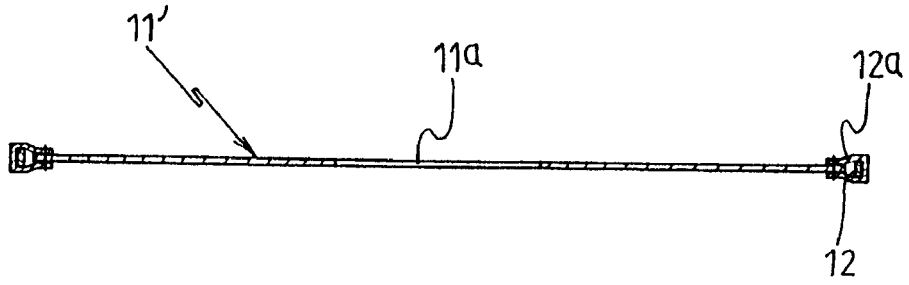
FIG. 2b PRIOR ART
Figure 2C:
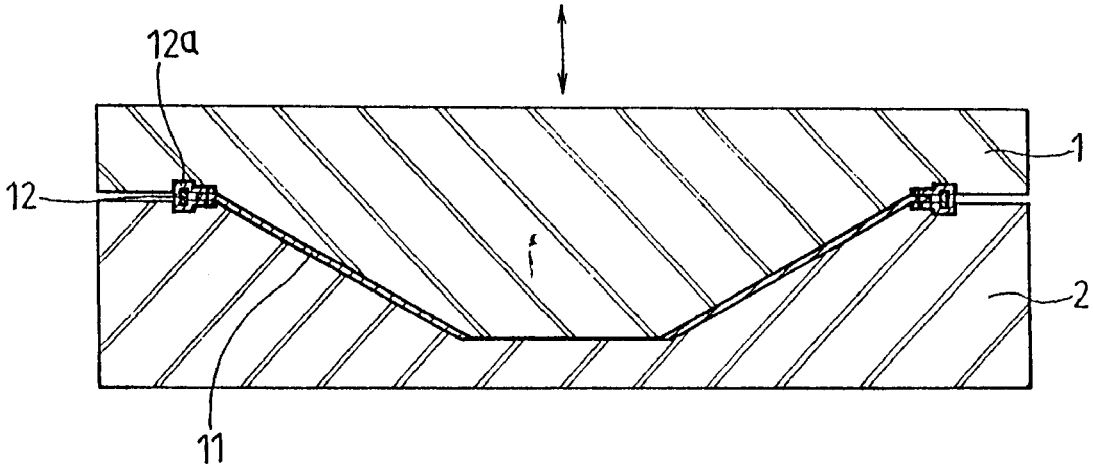
FIG. 2c PRIOR ART
Figure 2D:
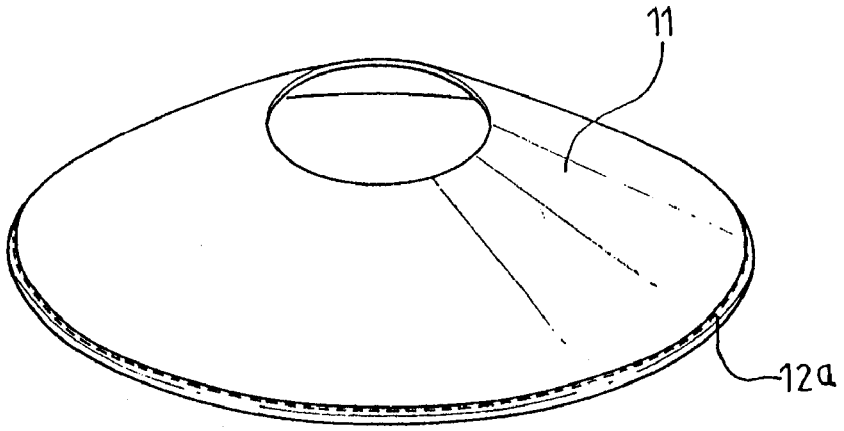
FIG. 2d PRIOR ART

Reference now should be made to the drawings, in which the same reference numerals are used throughout the different drawings to designate the same or similar components.

Figure 3:
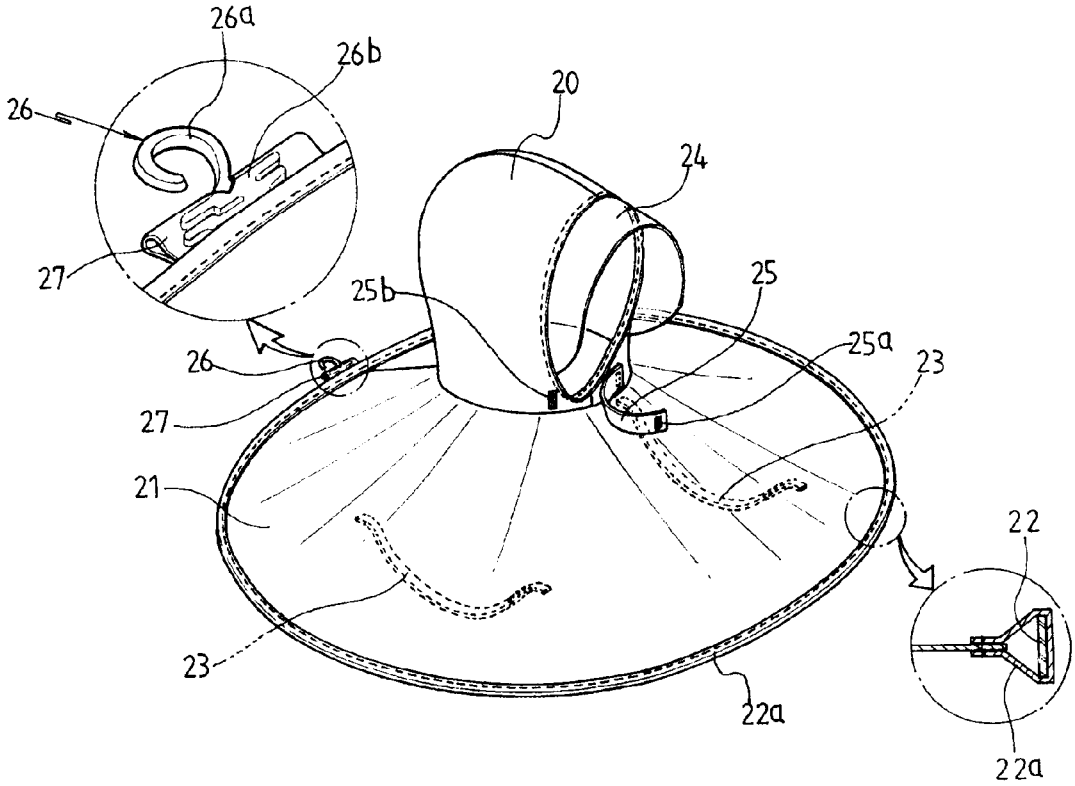
FIG. 3 is a perspective view of one exemplary embodiment of a head mounted umbrella according to the present invention.
Figure 4:
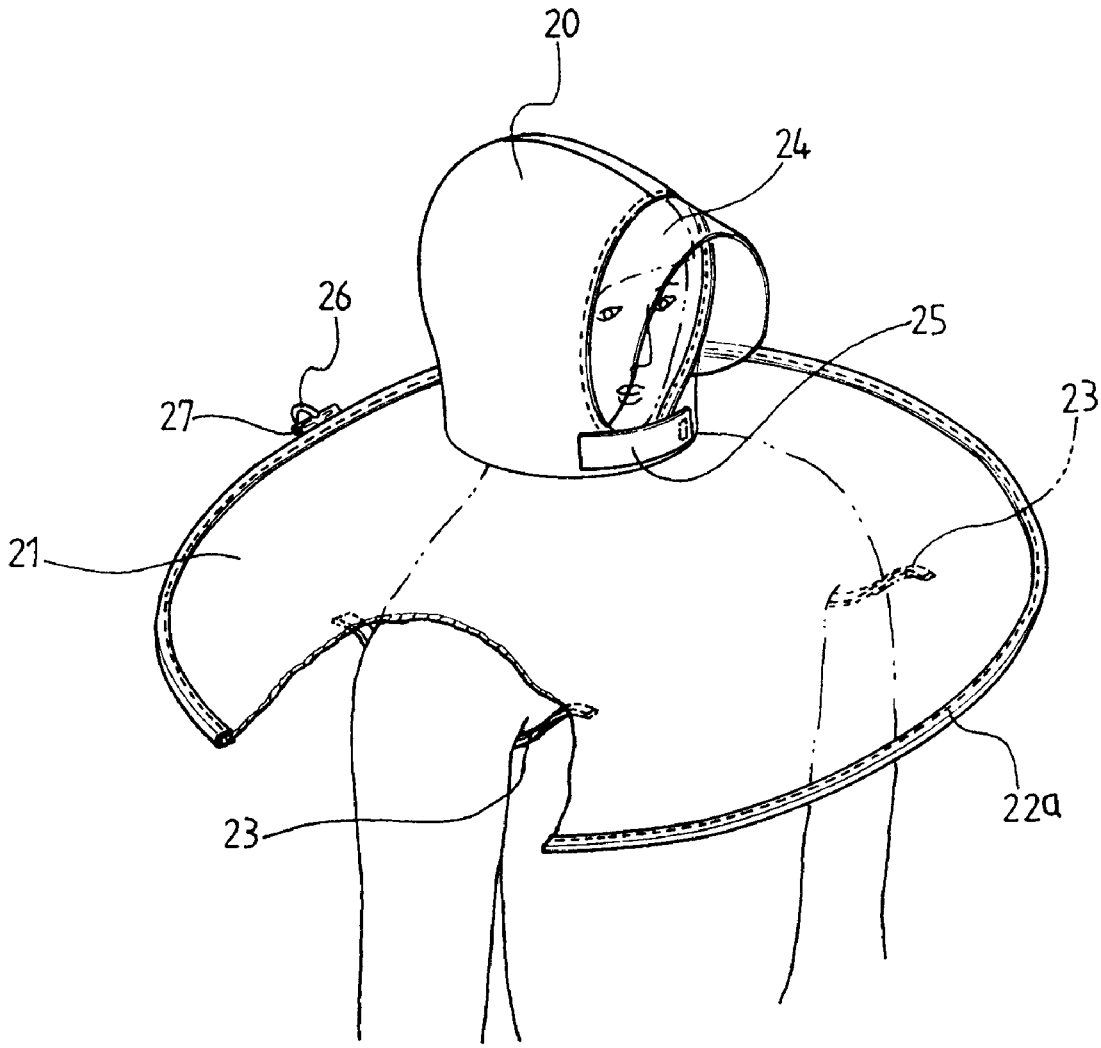
FIG. 4 is a perspective view of the umbrella according to the present invention worn on a user, and is partially broken away.

FIG. 3 is a perspective view showing a head mounted umbrella according to the present invention, and FIG. 4 is a perspective view showing the head mounted umbrella which is worn on a user's head.

As shown in the drawings, the head mounted umbrella according to the present invention comprises a hood part 20 made of a waterproof cloth and having a front opening, a body covering part 21 made of a waterproof cloth, which is coupled to a lower circumferential edge of the hood part 20 and is formed into a skirt shape or a conical shape, and an annular elastic ring 22 coupled to an outer peripheral edge of the body covering part 21 by an attaching cloth strip 22*a*.

The hood part 20, the body covering part 21 and the attaching cloth strip 22*a* may be produced by many kinds of material. Preferably, they are made of synthetic resin material, which is hard to tear and has an excellent water proofing property.

The body covering part 21 is manufactured in such a way that a basic cloth 21' (FIG. 5*a*) of a circular shape having a central opening 21*a* and at least one cut portion 21*c*, which is extended between an edge of the central opening and an outer edge of the basic cloth 21' and widened toward the outer edge of the basic cloth, is prepared, and adjacent radial edges 21*d* of the basic cloth 21' are coupled to each other to form a skirt shape.

The adjacent radial edges 21*d* of the basic cloth 21' can be coupled to each other by sewing, heat bonding or adhesives.

The annular elastic ring 22 is attached to a lower peripheral edge of the body covering part 21 is such a way that the annular elastic ring 22 is brought into contact with an inner surface of the attaching cloth strip 22*a*, the attaching cloth strip 22*a* is inwardly folded at upper and lower edges of the elastic ring 22 to form a "U" shape in section, the peripheral edge 21*b* of the body covering part 21 is disposed between the upper and lower folded edges of the attaching cloth strip 22*a*, and the upper and lower folded edges of the attaching cloth strip 22*a* are sewn together with the body covering part 21.

In addition, the head mounted umbrella according to the present invention is provided with a pair of auxiliary straps 23 at both sides of its lower surface. Although the auxiliary straps 23 may be various kinds of material and may be sized to have a certain length, they are preferably made of flexible material. The auxiliary straps 23 are attached to the lower surface of the body covering part 21 at both of their ends such that the straps 23 are positioned at a user's axillae.

The head mounted umbrella according to the present invention also includes a hood shade 24 which is forwardly extended from an upper edge of the front facial opening of the hood part 20, and a chin strap 25 which is attached at one end to a side of the hood part below the front facial opening to encircle a user's chin. The other end of the chin strap 25 is provided with a fastening member 25*a*, and the other side of the hood part below the front opening is provided with a fastening member 25*b* to mate with the fastening member 25*a* of the chin strap 25.

The hood shade 24 serves to prevent a user's face from being exposed to rain. It is preferable that the hood shade 24 be made of transparent synthetic resin material so as not to obstruct a user's view.

The chin strap 25 serves to prevent rain water from contacting a user's neck portion under his chin. The mating fastening members 25*a* and 25*b* include Velcro fasteners, buttons and so on.

The head mounted umbrella is also provided at a rear edge of the body covering part 21 with a hook member 26, which is connected to the rear edge by a connecting flap 27 attached to the rear edge. The hook member 26 comprises a hook portion 26*a* and a base portion 26*b* connected to the hook portion 26*a* and caught in the connecting flap 27. The hook member 26 is coupled to the rear edge of the body covering part 21 in such a way that the connecting flap 27 is first prepared from a rectangular vinyl sheet, the rectangular vinyl sheet is cut away at its center, the hook portion 26*a* of the hook member 26 is passed through the central cut portion of the vinyl sheet, the rectangular vinyl sheet is folded to surround the base portion 26*b* of the hook member 26, and the free edges of the folded vinyl sheet are sewn to a rear edge of the body covering part 21.

A process of manufacturing the head mounted umbrella according to the present invention will now be described.

Figure 5A:
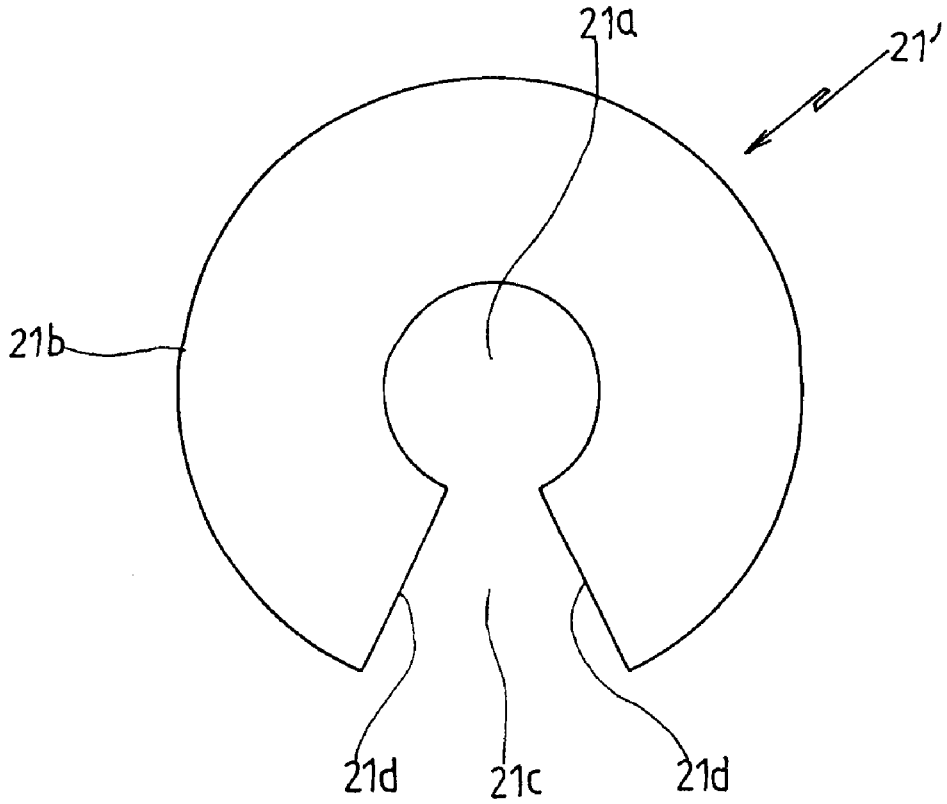
FIGS. 5*a* to 5*c* show a process of manufacturing a body covering part of the umbrella according to the present invention.
Figure 5B:
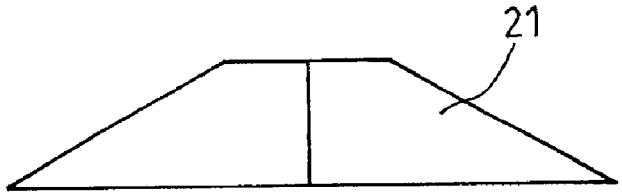
Figure 5C:
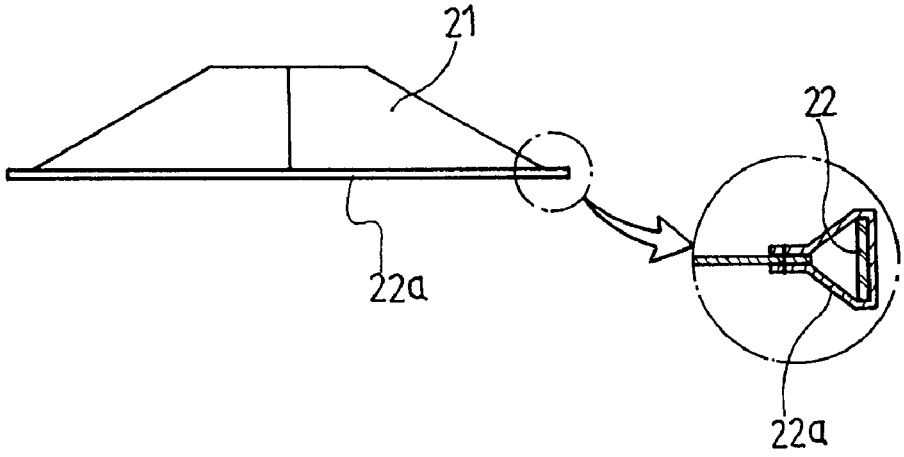

As shown in FIGS. 5*a* through 5*c*, a circular basic cloth 21' having a circular edge 21*b* is first cut away to have a central opening 21*a* and at least one cut portion 21*c* such that the cut portion 21*c* is extended between an edge of the central opening and the outer edge 21*b* of the basic cloth 21' is widened toward the outer edge 21*b* of the basic cloth 21'. Thereafter, adjacent radial edges 21*d* of the basic cloth 21' are coupled to each other to form a body covering part 21 having a skirt shape. An annular elastic ring 22 is coupled to the peripheral edge 21*b* of the skirt-shaped basic cloth 21' by an attaching strip 22*a*.

Figure 6:
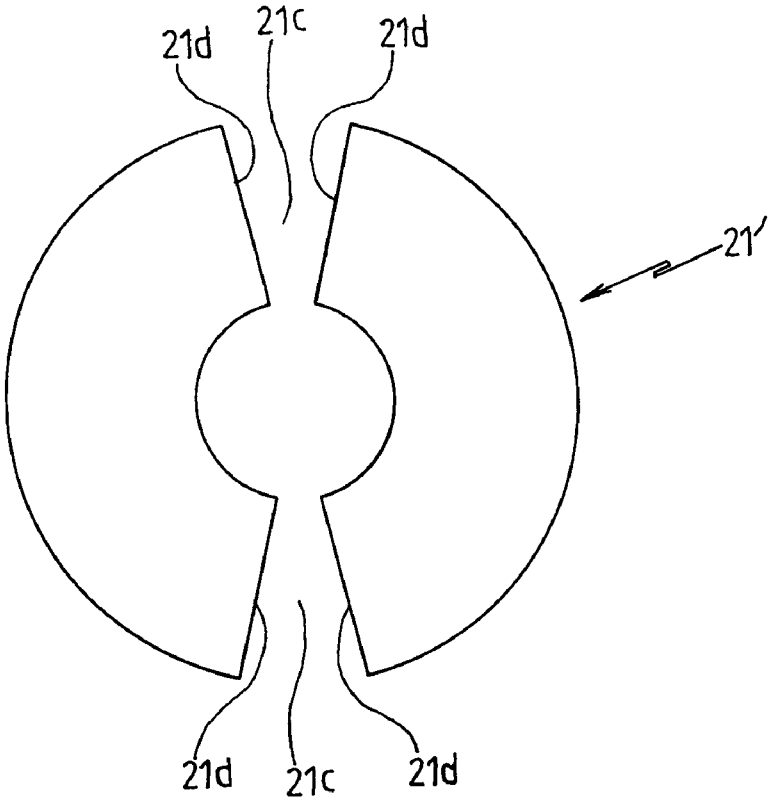
FIG. 6 is a plan view of another embodiment of a basic cloth for constituting the body covering part according to the present invention.

Although the basic cloth 21' is shown to have one cut portion 21*c* in FIG. 5*a*, the basic cloth 21' may have two cut portions 21*c* as shown in FIG. 6.

As mentioned above, the body covering part 21 is provided with a pair of auxiliary straps 23, one at each of both sides corresponding to a user's shoulders, and is provided with a hook member 26 at its rear peripheral edge.

The hood part 20 is separately manufactured. The hood part 20 is provided with the transparent hood shade 24, which is attached to an upper edge of the front facial opening of the hood part 21 by a sewing operation. The hood part 20 is further provided with the chin strap 25 below the front opening, which has the fastening member 25*a* at its one end. The hood part 20 is provided with the mating fastening member 25*b* at a position corresponding to the fastening member 25*a* of the chin strap 25.

The hood part 20, which is attached with the transparent hood shade 24 and the chin strap 25 in a manner described above, is coupled to the body covering part 21 by sewing a lower edge of the hood part 20 to an edge of the central opening of the body covering part 21. As a result, the head mounted umbrella according to the present invention is completely manufactured.

According to the present invention, since the body covering part 21 can be manufactured without molds, it is possible to reduce its manufacturing cost and time period. In addition, since the body covering part 21 is securely held on a user's shoulders by the auxiliary straps 23, the umbrella can be stably worn by the user without shaking when the umbrella is exposed to wind or collision with an adjacent object.

Furthermore, the head mounted umbrella can prevent a user's face from getting wet with rain water by the transparent hood shade 24 and the chin strap 25, and can be conveniently hung on a hanger by the hook member 26.

As is the case with the prior art umbrella of the inventor, the head mounted umbrella according to the present invention can be conveniently stored and carried because the annular elastic ring 22 can be folded many times to be compact and the body covering part 21 and the elastic ring 22 can be packed in the hood part 20.

As described above, the present invention provides a head mounted umbrella which is intended to remarkably reduce its manufacturing cost and time and to be stably held on a user's body without shaking. Furthermore, the head mounted umbrella according to the present invention can prevent a user's face from getting wet with rain water by the transparent hood shade, and can be conveniently hung on a hanger by its hook member.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A head mounted umbrella comprising:

a hood part made of a waterproof material and having a front opening, wherein the hood part is provided with a chin strap which is attached at one end thereof to a side of the hood part below the front opening to encircle a user's chin portion, and another end of the chin strap is provided with a fastening member, and wherein the hood part is provided at another side below the front opening with a fastening member to mate with the fastening member of the chin strap;

a body covering part made of a waterproof material, which is manufactured from a circular basic cloth having a central opening and at least one cut portion, wherein the cut portion is extended between an edge of the central opening and an outer edge of the basic cloth and is widened toward the outer edge of the basic cloth, and wherein adjacent radial edges of the basic cloth are coupled to each other to form a skirt shape, and wherein said body covering part is coupled to a lower edge of the hood part; and an annular elastic ring coupled to an outer peripheral edge of the body covering part by an attaching cloth strip.

2. The head mounted umbrella as set forth in claim 1, wherein the body covering part is provided with a pair of auxiliary straps at both sides of its lower surface corresponding to a user's shoulders.

3. The head mounted umbrella as set forth in claim 1, wherein the hood part is provided with a hood shade at an upper edge of the front opening, which is forwardly extended by a certain length.

4. A head mounted umbrella comprising:

a hood part made of a waterproof material and having a front opening;

a body covering part made of a waterproof material, which is manufactured from a circular basic cloth having a central opening and at least one cut portion, wherein the cut portion is extended between an edge of the central opening and an outer edge of the basic cloth and is widened toward the outer edge of the basic cloth, and wherein adjacent radial edges of the basic cloth are coupled to each other to form a skirt shape, and wherein the body covering part is provided at its outer peripheral edge with a hook member attached thereto, wherein said body covering part is coupled to a lower edge of the hood part; and an annular elastic ring coupled to an outer peripheral edge of the body covering part by an attaching cloth strip.

5. The head mounted umbrella as set forth in claim 4, wherein the hood part is provided with a chin strap which is attached at one end thereof to a side of the hood part below the front opening to encircle a user's chin portion, and another end of the chin strap is provided with a fastening member, and wherein the hood part is provided at another side below the front opening with a fastening member to mate with the fastening member of the chin strap.

6. A method of manufacturing a head mounted umbrella, comprising the steps of:

preparing a hood part made of a waterproof cloth and having a front opening, including providing the hood part with a chin strap that is attached at one end thereof to a side of the hood part below the front opening to encircle a user's chin portion, providing another end of the chin strap with a fastening member, and providing another side of the hood part below the front opening with a fastening member to mate with the fastening member of the chin strap;

preparing a body covering part made of a waterproof cloth, which is manufactured in such a way that a circular basic cloth having a circular edge is cut away to have a central opening and at least one cut portion such that the cut portion is extended between an edge of the central opening and the outer edge of the basic cloth and is widened toward the outer edge of the basic cloth;

connecting adjacent radial edges of the basic cloth to each other to form a skirt shape; and attaching an annular elastic ring to the outer edge of the skirt-shaped basic cloth by an attaching strip.

* * * * *